US010746430B2

(12) United States Patent
Park

(10) Patent No.: US 10,746,430 B2
(45) Date of Patent: Aug. 18, 2020

(54) CENTRALIZED AUTOMATIC CONTROL SYSTEM CAPABLE OF REMOTELY CONTROLLING VIABLE AIR VOLUME DIFFUSER OF THERMAL DRIVING METHOD

(71) Applicant: YOUONE ENGINEERING CO., LTD., Seoul (KR)

(72) Inventor: Seong Kyu Park, Seoul (KR)

(73) Assignee: YOUONE ENGINEERING CO., LTD., Seoul (KR)

( * ) Notice: Subject to any disclaimer, the term of this patent is extended or adjusted under 35 U.S.C. 154(b) by 486 days.

(21) Appl. No.: 15/529,498

(22) PCT Filed: Feb. 10, 2017

(86) PCT No.: PCT/KR2017/001464
§ 371 (c)(1),
(2) Date: May 25, 2017

(87) PCT Pub. No.: WO2017/164513
PCT Pub. Date: Sep. 28, 2017

(65) Prior Publication Data

US 2018/0187914 A1 Jul. 5, 2018

(30) Foreign Application Priority Data

Mar. 22, 2016 (KR) ..... 10-2016-0033963

(51) Int. Cl.
*F24F 11/00* (2018.01)
*F24F 11/76* (2018.01)
(Continued)

(52) U.S. Cl.
CPC ..... *F24F 11/76* (2018.01); *F24F 11/54* (2018.01); *F24F 11/56* (2018.01); *F24F 11/59* (2018.01);
(Continued)

(58) Field of Classification Search
CPC .. F24F 11/54; F24F 11/56; F24F 11/59; F24F 11/64; F24F 11/76; F24F 13/06; F24F 13/10; F24F 2013/144
See application file for complete search history.

(56) References Cited

U.S. PATENT DOCUMENTS 3,967,779 A * 7/1976 Logsdon ..... F16K 11/16 236/49.5
4,523,713 A * 6/1985 Kline ..... F24F 11/76 236/1 C
(Continued)

FOREIGN PATENT DOCUMENTS

KR 10-2008-0088741 A 10/2008
KR 20-2012-0003893 U 6/2012
(Continued)

OTHER PUBLICATIONS

International Search Report for PCT/KR2017/001464 dated May 16, 2017 from Korean Intellectual Property Office.

*Primary Examiner* — Jonathan Bradford
(74) *Attorney, Agent, or Firm* — Revolution IP, PLLC

(57) ABSTRACT

A centralized automatic control system includes a master diffuser including a sensor box unit and a controller provided with a hot-wire unit to which power is supplied, a piston connected to the hot-wire unit, a supply air damper connected to the piston, and a discharge port connected to the supply air damper to be opened and closed; a remote control unit included in a building automation system (BAS) and installed with control software to monitor room temperature sensed by the master diffuser and supply air temperature of supply air supplied into a room and input a preset temperature into the master diffuser; and a second diffuser installed with a terminal box unit and operating in subordination to the master diffuser.

4 Claims, 4 Drawing Sheets

(51) Int. Cl.

| | |
|---|---|
| ***F24F 11/74*** | (2018.01) |
| ***F24F 11/79*** | (2018.01) |
| ***F24F 11/56*** | (2018.01) |
| ***F24F 11/63*** | (2018.01) |
| ***F24F 13/06*** | (2006.01) |
| ***F24F 11/54*** | (2018.01) |
| ***F24F 11/59*** | (2018.01) |
| *F24F 110/10* | (2018.01) |

(52) U.S. Cl.
CPC ..... *F24F 11/63* (2018.01); *F24F 11/74* (2018.01); *F24F 11/79* (2018.01); *F24F 13/06* (2013.01); *F24F 2110/10* (2018.01)

(56) References Cited

U.S. PATENT DOCUMENTS

| | | | | |
|---|---|---|---|---|
| 5,535,814 | A * | 7/1996 | Hartman | F24F 11/30 165/217 |
| 6,736,326 | B2 * | 5/2004 | Hunka | F24F 11/76 236/1 C |
| 7,641,125 | B2 * | 1/2010 | Rimmer | F24F 13/06 236/49.3 |
| 2001/0042792 | A1 | 11/2001 | Kline et al. | |

FOREIGN PATENT DOCUMENTS

| | | | |
|---|---|---|---|
| KR | 10-2013-0092894 | A | 8/2013 |
| KR | 10-1410029 | B1 | 6/2014 |

* cited by examiner

CENTRALIZED AUTOMATIC CONTROL SYSTEM CAPABLE OF REMOTELY CONTROLLING VIABLE AIR VOLUME DIFFUSER OF THERMAL DRIVING METHOD

CROSS REFERENCE TO PRIOR APPLICATIONS

This application is a National Stage Application of PCT International Patent Application No. PCT/KR2017/001464 filed on Feb. 10, 2017, under 35 U.S.C. § 371, which claims priority to Korean Patent Application No. 10-2016-0033963 filed on Mar. 22, 2016, which are all hereby incorporated by reference in their entirety.

TECHNICAL FIELD

The present invention relates to a centralized automatic control system capable of remotely controlling a variable air volume diffuser of a thermal driving method, and more specifically, to a centralized automatic control system capable of remotely controlling a variable air volume diffuser of a thermal driving method, in which since a remote and centralized control system may monitor room temperature and set a desired temperature in a variable air volume air conditioning system in which a variable air volume diffuser provided with a room temperature sensor operating according to phase change of a shape conversion material and a driving device that does not have an electric power supply or an air pressure switch in each device to independently control air volume is directly exposed and operates in an indoor space, an indoor air conditioning environment desired by a user can be created.

BACKGROUND ART

Most of large buildings constructed recently such as a mart, a department store, and an apartment house and the like are equipped with an air conditioning system such as a cooling and heating device or a ventilation device to maintain indoor air in a comfortable state, and the air controlled by the cooling and heating device or the ventilation device (heated or cooled air or fresh air) is transferred to predetermined indoor places along air ducts without loss and discharged to be diffused by an air diffuser installed at the end of each air duct.

The air diffuser is installed in a building to supply air inside the building, and polluted indoor air is filtered or cold outside air is heated warm, and thus finally discharged air may have a proper temperature.

Conditions (temperature, humidity, cleanness and the like) of the air are usefully changed by the air diffuser as described above, and the air may flow toward the inside of the building along main tubes such as ducts or the like.

The diffuser described above may be installed to hide the ends of the ducts not to be directly seen in the rooms and to create further lovely rooms from the aspect of interior decoration.

Meanwhile, a temperature sensor for sensing room temperature and a damper for opening and closing a discharge port of the air diffuser by the temperature sensor is installed in the air diffuser.

Through the configuration as described above, the temperature sensor senses change of room temperature as the room temperature changes and adjusts a moving distance of the damper which opens the discharge port, and thus the room temperature can be controlled by adjusting the air volume.

However, since the temperature sensor of the conventional air diffuser described above operates according to change of room temperature, there is a problem in that it is difficult for a user to arbitrarily control the room temperature, and although the room temperature needs to be controlled from the outside depending on situations, the room temperature cannot be controlled through a remote control from the outside.

DISCLOSURE OF INVENTION

Technical Problem

The present invention has been conceived to solve the problems described above, and an object of the present invention is to provide a centralized automatic control system capable of remotely controlling a variable air volume diffuser of a thermal driving method, in which if a set temperature is input from a remote site according to sensed room temperature after installing a resistance heating wire in an integrated heat sensing driver and supplying several steps of weak electric current to the resistance heating wire through a remote controller to generate several steps of low heat, low heat supplied to the resistance heating wire as much as a difference between the room temperature and the set temperature among the several steps of low heat is remotely controlled, and thus an indoor air conditioning environment desired by a user can be created by adjusting air ventilation volume through an air volume control unit.

Technical Solution

A centralized automatic control system capable of remotely controlling a variable air volume diffuser of a thermal driving method of the present invention for accomplishing the above objects comprises: a master diffuser including a room temperature sensing unit including a room temperature sensor, a supply air temperature sensing unit including a supply air temperature sensor, a sensor box unit provided with a hot-wire unit to which power is supplied, a controller, a piston connected to the hot-wire unit, a supply air damper connected to the piston, and a discharge port connected to the supply air damper to be opened and closed; a remote control unit included in a building automation system (BAS) and installed with control software to monitor room temperature sensed by the master diffuser and supply air temperature of supply air supplied into a room and input a preset temperature into the master diffuser; and a second diffuser installed with a terminal box unit and operating in subordination to the master diffuser, wherein the room temperature is adjusted to the set temperature by calculating a needed heat value corresponding to a difference between the room temperature measured by the room temperature sensing unit and the set temperature previously set by the remote control unit, supplying power to the hot-wire unit of the master diffuser to generate low heat corresponding to the needed heat value, varying a distance of reciprocating movement of the piston connected to the hot-wire unit, controlling an opening angle of the supply air damper connected to the piston, and adjusting an opening degree of the discharge port connected to the supply air damper.

The second diffuser includes: a hot-wire unit to which power is supplied, a piston connected to the hot-wire unit, a supply air damper connected to the piston, and a discharge port connected to the supply air damper to be opened and closed, wherein an opening degree of the discharge port of the second diffuser may be adjusted by supplying power the same as the power supplied to the master diffuser.

A plurality of second diffusers may be connected to one master diffuser.

The sensor box unit may include a supply air temperature sensor for measuring supply air temperature, a room temperature sensor for measuring room temperature, and a master hot-wire connection unit connected to the hot-wire unit to supply power to the hot-wire unit; and the terminal box unit may include a second hot-wire connection unit connected to a hot-wire unit to supply power to the hot-wire unit; and the controller may transfer the supply air temperature received from the supply air temperature sensor and the room temperature received from the room temperature sensor to a remote control unit, receive the set temperature from the remote control unit, and calculate a value of power to be supplied to the hot-wire unit and transfer the value of power to the master hot-wire connection unit so that low heat as much as to adjust the room temperature to the set temperature may be generated from the hot-wire unit.

The sensor box unit may transfer the value of power received from the controller to a second hot-wire connection unit of the terminal box unit.

The room temperature sensing unit is provided to perform reciprocating movement of the piston connected to the supply air damper according to change of volume of working fluid filled in a cylinder if the room temperature changes, and a range of the reciprocating movement of the piston may further increase by generating low heat from the hot-wire wrapped around the room temperature sensing unit.

Advantageous Effects

According to the centralized automatic control system capable of remotely controlling a variable air volume diffuser of a thermal driving method of the present invention as described above, there is an effect of creating an indoor air conditioning environment desired by a user by remotely inputting a set temperature according to sensed room temperature after installing a resistance heating wire in an integrated heat sensing driver and supplying several steps of weak electric current to the resistance heating wire through a remote controller to generate several steps of low heat, remotely controlling to supply the low heat to the resistance heating wire as much as a difference between the room temperature and the set temperature among the several steps of low heat, and adjusting air ventilation volume through an air volume control unit.

| DESCRIPTION OF SYMBOLS | |
|---|---|
| 100: Remote control unit | 200: Master diffuser |
| 210: Controller | 230: Sensor box unit |
| 231: Supply air temperature sensor | |
| 233: Room temperature sensor | |
| 235: First heating hot-wire connection unit | |
| 237: First cooling hot-wire connection unit | |
| 300: Second diffuser | 330: Terminal box unit |
| 335: Second heating hot-wire connection unit | |
| 337: Second cooling hot-wire connection unit | |
| 510: Room temperature sensing unit for heating | |
| 515: Heating hot-wire unit | |
| 530: Room temperature sensing unit for cooling | |
| 535: Cooling hot-wire unit | |
| 550: Supply air temperature sensing unit | |
| 570: Supply air damper | 580: discharge port |
| 590: piston | |

BEST MODE FOR CARRYING OUT THE INVENTION

Hereinafter, a preferred embodiment of the present invention will be described in detail with reference to accompanying drawings so that those skilled in the art may easily embody the present invention.

Figure 1:
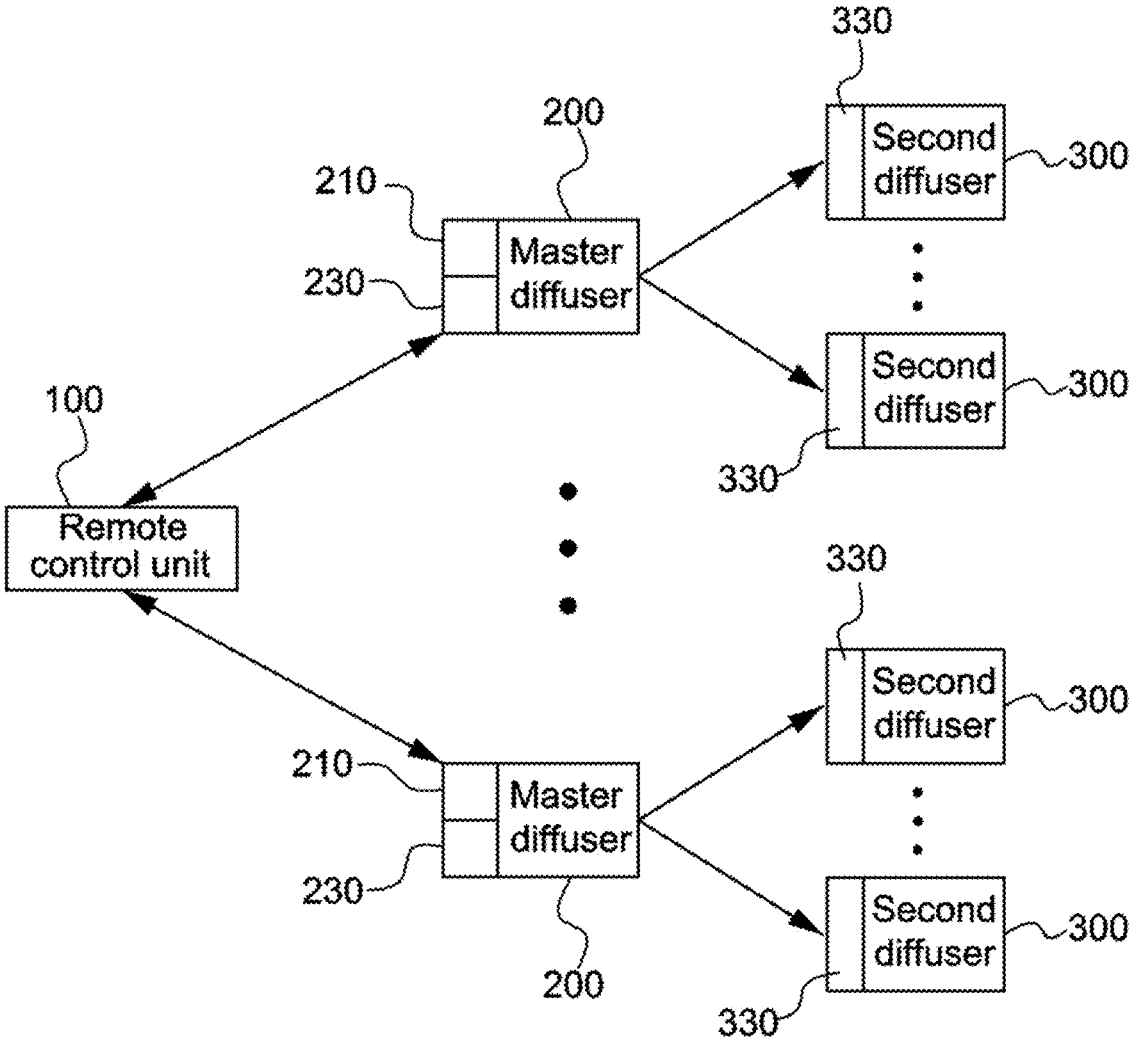
FIG. 1 is a block diagram showing a centralized automatic control system capable of remotely controlling a variable air volume diffuser of a thermal driving method according to an embodiment of the present invention.

As shown in FIG. 1, a remote and centralized automatic control system of a variable air volume diffuser of a thermal driving method according to an embodiment of the present invention includes a remote control unit 100, a master diffuser 200 and a second diffuser 300.

The remote control unit 100 monitors room temperature sensed by the master diffuser 200 or the second diffuser 300 and supply air temperature of supply air supplied into a room and transfers a preset temperature to the master diffuser 200.

Control software is installed in the remote control unit 100, and the remote control unit 100 may be a terminal such as a PC or the like at a remote site, which can display the room temperature and the supply air temperature on a monitor and input a preset temperature, or the remote control unit 100 can be provided in the form of a control panel installed on a wall or the like of a room to display the room temperature and the supply air temperature and input a preset temperature.

Figure 2:
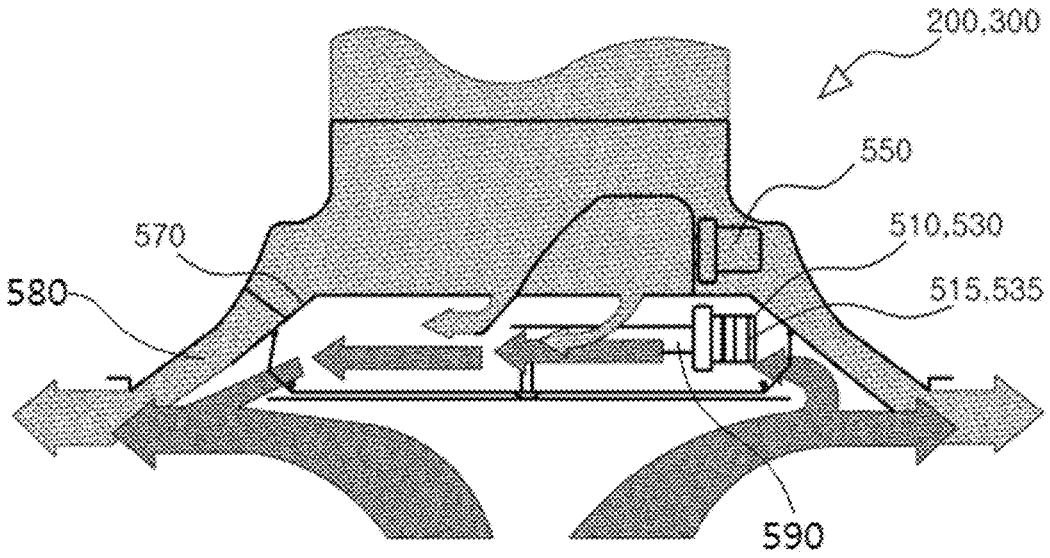
FIG. 2 is an exemplary view showing a variable air volume diffuser of a thermal driving method according to an embodiment of the present invention.

As shown in FIG. 2, the master diffuser 200 includes a diffuser body of a hopper shape installed in a ceiling duct of a building, a base plate installed at the center of the discharge side of the diffuser body, and a supply air damper 570 hinge-coupled to each circumferential surface of the base plate to open and close a discharge port 580 communicating with the room.

In addition, the master diffuser 200 includes a supply air temperature sensing unit 550 for sensing room temperature through the room temperature sensing units 510 and 530 installed on the top surface of the base plate and automatically controlling switching between cooling and heating in proportion to change of supply air temperature of the air supplied into the room.

The room temperature sensing unit includes a room temperature sensing unit for heating 510 which operates when the air-conditioning is switched to heating mode through the supply air temperature sensing unit 550 and a room temperature sensing unit for cooling 530 which operates when the air-conditioning is switched to cooling mode through the supply air temperature sensing unit 550.

The room temperature sensing units 510 and 530 are configured of a cylinder filled with a fluid which varies its volume according to change of temperature, a piston 590 which is axis-coupled in the cylinder and moves forward when the fluid expands, and an elastic member such as a coil spring or the like for elastically supporting the piston 590 to restore the piston 590 when the fluid contracts.

The cylinder can be manufactured using a material having superior heat conductivity, particularly, brass, and a fluid containing wax of a petrochemical family as a major component may be filled in the cylinder. The wax expands and pushes the piston 590 if temperature rises, and the piston 590 operates to be restored using elasticity of the elastic member as the volume of the wax is reduced if the temperature decreases.

Accordingly, the piston 590 is connected to the supply air damper 570, rotates a control plate holding the supply air damper 570 as much as a predetermined angle through reciprocating movement of moving back and forth, and may open and close the discharge port 580 accordingly.

That is, the room temperature sensing units 510 and 530 sense room temperature and provide a power source for adjusting the opening angle of the supply air damper 570 according to change of the temperature.

The room temperature sensing unit for heating 510 is provided with a heating hot-wire unit 515 formed by wrapping a separate hot-wire, and the room temperature sensing unit for cooling 530 is provided with a cooling hot-wire unit 535 formed by wrapping a separate hot-wire, and if low heat is generated by supplying a small amount of power to each of the heating hot-wire unit 515 and the cooling hot-wire unit 535, expansion of the fluid in the room temperature sensing units 510 and 530 increases, and the range of pushing the piston 590 further increases, and thus the range of the reciprocating movement of the piston 590 further increases.

A controller 210 and a sensor box unit 230 are installed in the master diffuser 200.

Figure 3:
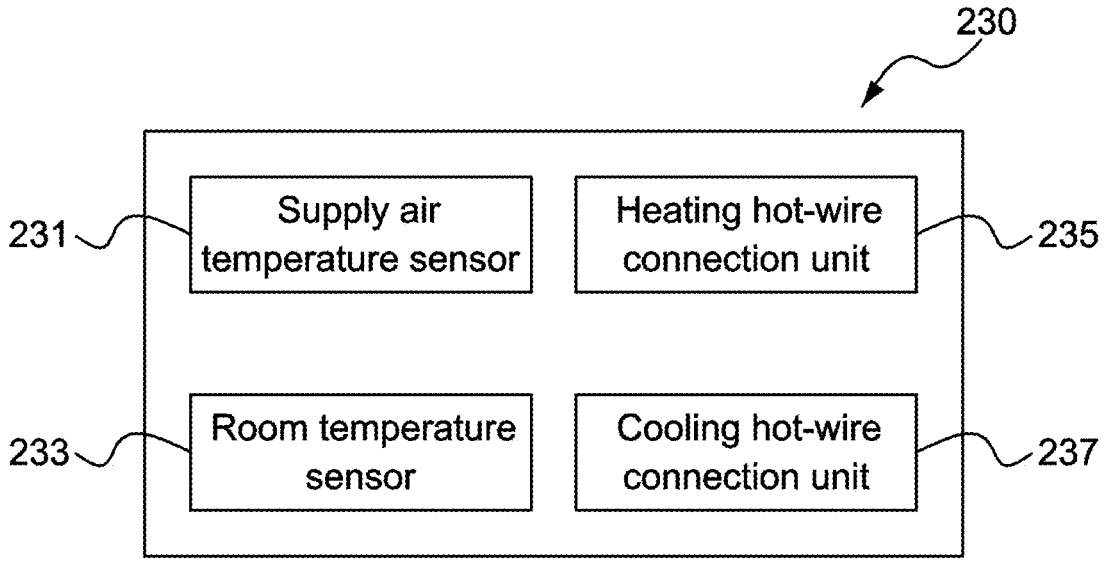
FIG. 3 is a block diagram showing a sensor box unit according to an embodiment of the present invention.

As shown in FIG. 3, the sensor box unit 230 includes a supply air temperature sensor 231 for measuring supply air temperature, a room temperature sensor 233 for measuring room temperature, a first heating hot-wire connection unit 235 connected to the heating hot-wire unit 515 to supply a small amount of power to the heating hot-wire unit 515, and a first cooling hot-wire connection unit 237 connected to the cooling hot-wire unit 535 to supply a small amount of power to the cooling hot-wire unit 535.

The controller 210 transfers the supply air temperature received from the supply air temperature sensor 231 of the sensor box unit 230 and the room temperature received from the room temperature sensor 233 to the remote control unit 100, receives a preset temperature from the remote control unit 100, calculates a value of a small amount of power to be supplied to the hot-wire unit 515 or 535, and transfers the value of power to the first heating hot-wire connection unit 235 or the first cooling hot-wire connection unit 237 so that heat as low as to adjust the room temperature to the set temperature may be generated from the hot-wire unit 515 or 535.

Since the first heating hot-wire connection unit 235 or the first cooling hot-wire connection unit 237 supplies power to the hot-wire unit 515 or 535 as much as the power value calculated and transferred through the controller 210, low heat is generated from the hot-wire unit 515 or 535, and accordingly, the room temperature sensing units 510 and 530 sense adjusted temperature, rather than actual room temperature, as room temperature, and the distance of reciprocating movement of the piston 590 is changed according thereto, and since the opening angle of the supply air damper 570 is corrected and the hole size of the discharge port 580 is adjusted, the room temperature can be adjusted to the set temperature.

For reference, the force of opening the supply air damper 570 may be provided by the movement of the piston 590 provided in the room temperature sensing units 510 and 530, and the force of closing the supply air damper 570 may be provided using a separate elastic member.

Since the second diffuser 300 is provided in a form the same as that of the master diffuser 200 as shown in FIG. 2, detailed descriptions of the portions the same as those of the master diffuser 200 will be omitted.

Instead of the controller 210 and the sensor box unit 230, a terminal box unit 330 is installed in the second diffuser 300.

Figure 4:
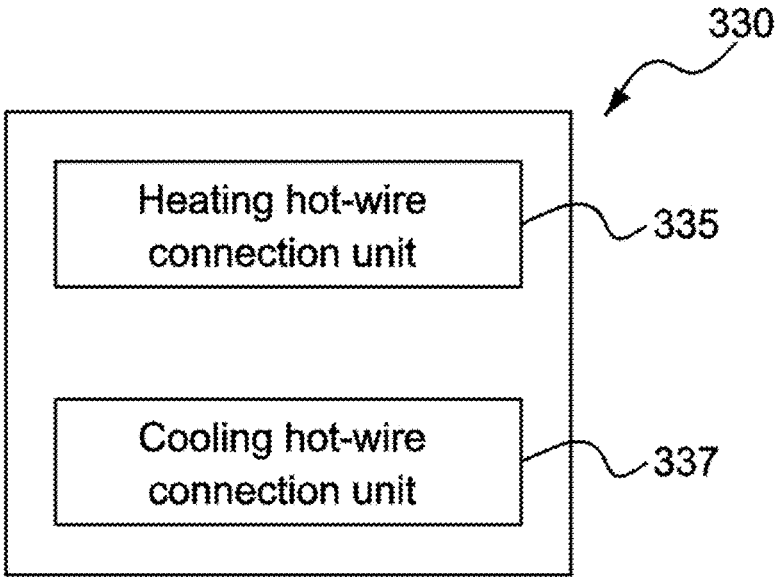
FIG. 4 is a block diagram showing a terminal box unit according to an embodiment of the present invention.
Figure 5:
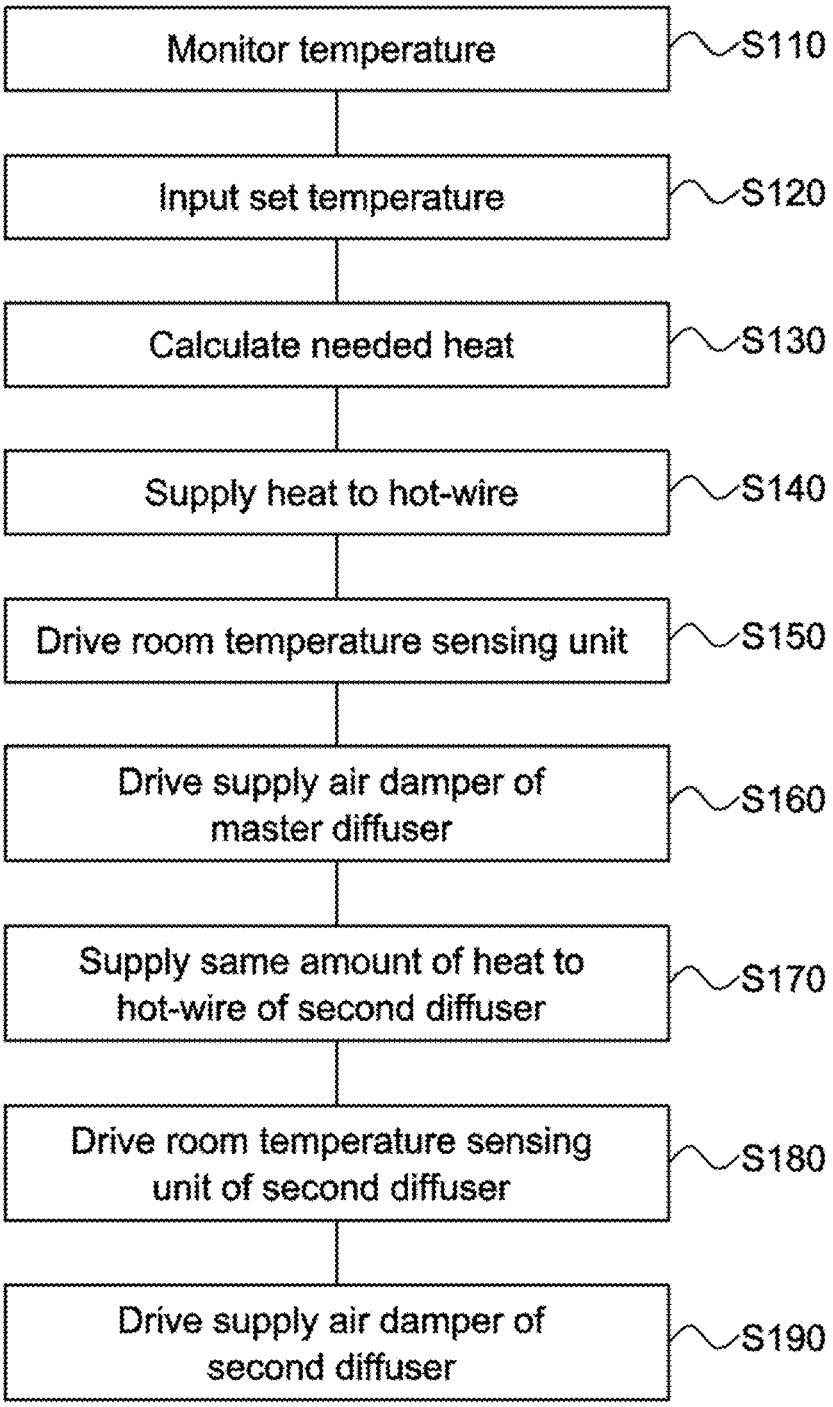
FIG. 5 is a flowchart illustrating an operation procedure performed through a centralized automatic control system capable of remotely controlling a variable air volume diffuser of a thermal driving method according to an embodiment of the present invention.

As shown in FIG. 4, the terminal box unit 330 includes a second heating hot-wire connection unit 335 connected to the heating hot-wire unit 515 of the second diffuser 300 to supply a small amount of power to the heating hot-wire unit 515 and a second cooling hot-wire connection unit 337 connected to the cooling hot-wire unit 535 to supply a small amount of power to the cooling hot-wire unit 535.

In the terminal box unit 330, the second heating hot-wire connection unit 335 and the second cooling hot-wire connection unit 337 receive the value of a small amount of power calculated by the controller 210 and transferred to the first heating hot-wire connection unit 235 or the first cooling hot-wire connection unit 237 of the sensor box unit 230, and low heat is also generated from the hot-wire unit 515 or 535 of the second diffuser 300.

That is, the second diffuser 300 operates in subordination to the master diffuser 200, and since the second diffuser 300 also receives a value of a small amount of power the same as the value of a small amount of power calculated through the controller 210 and applied to the hot-wire unit 515 or 535 of the master diffuser 200 and applies the value of the power to the hot-wire unit 515 or 535 of the second diffuser 300 to correct the room temperature, the hot-wire unit 515 or 535 of the master diffuser 200 and the hot-wire unit 515 or 535 of the second diffuser 300 generate low heat of equal level.

For reference, the value of power supplied to the hot-wire unit 515 or 535 according to the difference between the room temperature and the set temperature may increase or decrease in steps, and the larger the difference between the room temperature and the set temperature, the larger the value of power supplied to the hot-wire unit 515 or 535.

Since the maximum power consumed by the heating hot-wire unit 515 and the cooling hot-wire unit 535 is about 0.5 watts respectively, the maximum power consumed by the hot-wire units 515 and 535 of the master diffuser 200 and the second diffuser 300 is about 1 watt respectively.

A plurality of master diffusers 200 may be provided in subordination to one remote control unit 100, and a plurality of second diffusers 300 may be provided in subordination to one master diffuser 200.

For reference, only master diffusers 200 can be provided without second diffusers 300.

In the remote and centralized automatic control system of a variable air volume diffuser of a thermal driving method configured as described above, first, the remote control unit 100 monitors supply air temperature and room temperature transferred from the supply air temperature sensor 231 and the room temperature sensor 233 (step S110).

Subsequently, a preset temperature is input through the remote control unit 100 and transferred to the controller 210 of the master diffuser 200 (step S120), and the controller 210 calculates a correction value as large as a temperature corresponding to a difference between the room temperature sensed through the room temperature sensor 233 and the set temperature input from the remote control unit 100 and calculates a needed amount of heat corresponding to the correction value (step S130).

Subsequently, if power is supplied to the hot-wire unit 515 or 535 of the master diffuser 200 to generate a needed amount of heat corresponding to the calculated correction value (step S140), the room temperature sensing units 510 and 530 sense adjusted temperature, rather than actual room temperature, as room temperature, and a distance of reciprocating movement of the piston 590 is changed according thereto (step S150), and subsequently, since the opening angle of the supply air damper 570 is corrected and the hole size of the discharge port 580 is adjusted, the room temperature is adjusted to the set temperature (step S160).

Subsequently, the hot-wire unit 515 or 535 provided in the second diffuser 300 subordinated to the master diffuser 200 also receives a value of a small amount of power calculated through the controller 210 and applied to the hot-wire unit 515 or 535 of the master diffuser 200 (step S170), and accordingly, the room temperature sensing units 510 and 530 of the second diffuser 300 sense adjusted temperature, rather than actual room temperature, as room temperature, and the distance of reciprocating movement of the piston 590 is changed according thereto (step S180), and subsequently, since the opening angle of the supply air damper 570 is corrected and the hole size of the discharge port 580 is adjusted, the room temperature is adjusted to the set temperature (step S190).

For example, when the supply air temperature sensing unit 550 is switched to cooling mode and performs a cooling operation, if the set temperature is changed to 24° C. through the remote control unit 100 while the set temperature initially input through the remote control unit 100 is 26° C. and the room temperature is 26° C., it is calculated through the controller 210 that the difference between the room temperature of 26° C. and the set temperature of 24° C. is 2° C., and if power needed to correct the calculated 2° C. is subsequently supplied to the cooling hot-wire unit 535 through the first cooling hot-wire connection unit 237, the room temperature sensing unit for cooling 530 senses the adjusted temperature, rather than actual room temperature, as room temperature, and the distance of reciprocating movement of the piston 590 is changed according thereto, and subsequently, since the opening angle of the supply air damper 570 is corrected and the hole size of the discharge port 580 is adjusted to increase the amount of the cold air flowing into the room, the room temperature is adjusted to the set temperature.

Subsequently, if power needed to correct the 2° C. calculated through the controller 210 is supplied to the cooling hot-wire unit 535 of the second diffuser 300 through the second cooling hot-wire connection unit 337 of the second diffuser 300, the room temperature sensing unit for cooling 530 of the second diffuser 300 senses the adjusted temperature, rather than actual room temperature, as room temperature, and the distance of reciprocating movement of the piston 590 is changed according thereto, and subsequently, since the opening angle of the supply air damper 570 is corrected and the hole size of the discharge port 580 is adjusted to increase the amount of the cold air flowing into the room, the room temperature is adjusted to the set temperature.

According to the remote and centralized automatic control system of a variable air volume diffuser of a thermal driving method of the present invention as described above, if a set temperature is input from a remote site according to sensed room temperature after installing a resistance heating wire in an integrated heat sensing driver and supplying several steps of weak electric current to the resistance heating wire through a remote controller to generate several steps of low heat, low heat supplied to the resistance heating wire as much as a difference between the room temperature and the set temperature among the several steps of low heat is remotely controlled, and thus an indoor air conditioning environment desired by a user can be created by adjusting the volume of the ventilated air flowing into the room.

Although a preferred embodiment of the present invention has been presented and described above, the present invention is not necessarily limited thereto, and those skilled in the art may be easily understood that various substitutions, modifications and changes can be made without departing from the spirits of the present invention.

INDUSTRIAL APPLICABILITY

According to the centralized automatic control system capable of remotely controlling a variable air volume diffuser of a thermal driving method of the present invention, if a set temperature is input from a remote site according to sensed room temperature after installing a resistance heating wire in an integrated heat sensing driver and supplying several steps of weak electric current to the resistance heating wire through a remote controller to generate several steps of low heat, low heat supplied to the resistance heating wire as much as a difference between the room temperature and the set temperature among the several steps of low heat is remotely controlled, and thus an indoor air conditioning environment desired by a user can be created by adjusting air ventilation volume through an air volume control unit.

The invention claimed is:

1. A centralized automatic control system comprising:

a master diffuser including a discharge port communicating with a room, a heating hot-wire unit and a cooling hot-wire unit generating heat by power, a sensor box unit including a supply air temperature sensor which measures supply air temperature, a room temperature sensor which measures room temperature, a first heating hot-wire connection unit connected the heating hot-wire unit and configured to supply power to the heating hot-wire unit, and a first cooling hot-wire connection unit connected to the cooling hot-wire unit and configured to supply power to the cooling hot-wire unit, a piston connected to the heating hot-wire unit and the cooling hot-wire unit, the piston moving forward or backward when the heating hot-wire unit or the cooling hot-wire unit generates heat, a supply air damper installed at the discharge port and connected to the piston, the supply air damper opening and closing the discharge port by the movement of the piston, and a controller configured to transfer the supply air temperature received from the supply air temperature sensor and the room temperature received from the room temperature sensor to a remote control unit, to receive a preset temperature from the remote control unit, to calculate a value of power to be supplied to the heating hot-wire unit or the cooling hot-wire unit according to a difference between the room temperature and the preset temperature and to transfer the value of power to the first heating hot-wire connection unit or the first cooling hot-wire connection unit to supply power to the heating hot-wire unit or the cooling hot-wire unit;

the remote control unit included in a building automation system (BAS) and installed with control software to monitor room temperature sensed by the master diffuser and supply air temperature of supply air supplied into the room and transfer the preset temperature into the master diffuser; and a second diffuser including a heating hot-wire unit and a cooling hot-wire unit which generate heat by power and a terminal box unit, the second diffuser operating in subordination to the master diffuser, wherein the terminal box unit including a second heating hot-wire connection unit connected to the heating hot-wire unit of the second diffuser and configured to supply power to the heating hot-wire unit of the second diffuser, and a second cooling hot-wire connection unit connected to the cooling hot-wire unit of the second diffuser and configured to supply power to the cooling hot-wire unit of the second diffuser.

2. The system according to claim 1, wherein the second diffuser further includes:

a discharge port communicating with the room, a piston connected to the heating hot-wire unit and the cooling hot-wire unit of the second diffuser, the piston moving forward or backward when the heating hot-wire unit or the second cooling hot-wire unit of the second diffuser generates heat, a supply air damper installed at the discharge port and connected to the piston, the supply air damper opening and closing the discharge port by the movement of the piston.

3. The system according to claim 1, wherein a plurality of second diffusers is connected to one master diffuser.

4. The system according to claim 1, wherein the terminal box unit is configured to receive the value of power from the controller and to transfer the value of power to the second heating hot-wire connection unit or the second cooling hot-wire connection unit.

* * * * *